US010807160B2

(12) United States Patent
Du et al.

(10) Patent No.: US 10,807,160 B2
(45) Date of Patent: Oct. 20, 2020

(54) ALUMINUM ALLOY LOW-PRESSURE CASTING DEVICE AND PROCESS

(71) Applicant: CITIC Dicastal CO., LTD, Qinhuangdao (CN)

(72) Inventors: Dexi Du, Qinhuangdao (CN); Changhai Li, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 165 days.

(21) Appl. No.: 16/050,118

(22) Filed: Jul. 31, 2018

(65) Prior Publication Data

US 2019/0283120 A1 Sep. 19, 2019

(30) Foreign Application Priority Data

Mar. 13, 2018 (CN) ..... 2018 1 02042295

(51) Int. Cl.
*B22D 18/04* (2006.01)
*B22D 18/08* (2006.01)
*B22D 17/04* (2006.01)

(52) U.S. Cl.
CPC ..... *B22D 17/04* (2013.01); *B22D 18/04* (2013.01); *B22D 18/08* (2013.01)

(58) Field of Classification Search
CPC ..... B22D 18/02; B22D 18/04; B22D 39/06
See application file for complete search history.

(56) References Cited

U.S. PATENT DOCUMENTS 6,247,521 B1 * 6/2001 Kawai ..... B22D 18/04 164/119
6,698,494 B1 * 3/2004 Hansen ..... B22D 18/04 164/133
7,790,098 B2 * 9/2010 Mochizuki ..... B22D 18/04 266/78
2010/0108285 A1 5/2010 Mizuno
2014/0144561 A1 * 5/2014 Shin ..... C22C 21/02 148/698
2016/0045955 A1 * 2/2016 Sasaki ..... B22D 18/04 164/254
2016/0199906 A1 7/2016 Mochizuki

FOREIGN PATENT DOCUMENTS

CN 202224635 U 5/2012
EP 2319638 A2 * 5/2011 ..... B22D 18/02

OTHER PUBLICATIONS

EPO machine translation of EP 2319638 A2 (Year: 2011).*

* cited by examiner

*Primary Examiner* — Kevin E Yoon
(74) *Attorney, Agent, or Firm* — Calfee, Halter & Griswold LLP

(57) ABSTRACT

The present application discloses an aluminum alloy low-pressure casting device and an aluminum alloy low-pressure casting process. A riser tube is canceled, and the pressure kettle replaces original injection of compressed air into a holding furnace, thereby reducing the consumption of compressed air, and improving the production efficiency of the low-pressure casting process. A non-return stopper is used to space the low-pressure casting and the holding furnace, and molten aluminum alloy can be added into the holding furnace in real time without interrupting the low-pressure casting process, so that rejects affected by temperature field changes due to interrupt of the continuous casting process can be reduced, and the yield of the casting process is improved.

2 Claims, 1 Drawing Sheet

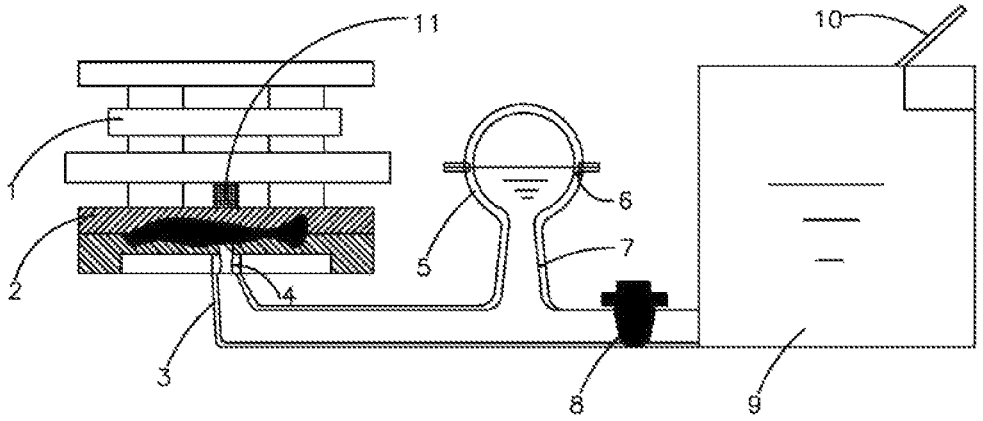
11
10
1
6
2
5
7
4
3
8
9

ALUMINUM ALLOY LOW-PRESSURE CASTING DEVICE AND PROCESS

CROSS-REFERENCE TO RELATED APPLICATIONS

This application claims priority to Chinese Patent Application No. 201810204229.5, filed on Mar. 13, 2018, which is hereby incorporated by reference in its entirety.

TECHNICAL FIELD

The present application relates to an aluminum alloy low-pressure casting device and an aluminum alloy low-pressure casting process.

BACKGROUND ART

Low-pressure casting is a mainstream molding process in the aluminum wheel manufacturing industry. Dry compressed air is applied to a holding furnace in the conventional low-pressure casting process and equipment so that a large amount of gas is consumed, and a large amount of electricity is consumed to heat the low-temperature compressed air in the furnace to maintain the temperature of molten aluminum alloy in the furnace. Usually, there is also a riser tube for connecting a mold with the molten aluminum alloy in the furnace. The riser tube has a length of more than 1 meter, and it consumes a lot of material, and needs long time for liquid rising and pressure relief. In general, in the aluminum alloy die-casting industry where the technical threshold is not high, the conventional low-pressure casting process and equipment, which is high in production cost, cannot meet the fierce competitive environment of the industry.

SUMMARY OF THE INVENTION

Based on the above background, the technical problem to be solved by the present application is to provide a low-pressure casting device and a low-pressure casting process for overcoming inefficient process and time costs of compressed air consumption, electricity consumption, liquid rising, pressure relief and the like in the conventional low-pressure casting holding furnace, and improving the process yield.

The technical solution adopted by the present application is: an aluminum alloy low-pressure casting process, comprises the steps of opening a non-return stopper after a mold is closed, injecting molten aluminum alloy into a holding furnace through a diversion trench, closing the non-return stopper after the molten aluminum alloy in a pressure kettle reaches an upper limit of the liquid level, opening a center plunger at the same time, injecting compressed air into the pressure kettle to implement a filling mold and holding process of low-pressure casting, unloading the pressure in the pressure kettle and evacuating the compressed air after a casting in the cavity of the mold is completely solidified, opening the mold to take the casting out, thus completing the entire low-pressure casting process.

According to the low-pressure casting device of the present application, a non-return stopper arranged on a diversion trench spaces a low-pressure casting main machine from a holding furnace to add molten aluminum alloy into the holding furnace continuously. When the non-return stopper is opened, the molten aluminum alloy in the holding furnace flows into the diversion trench for casting.

When the non-return stopper is closed, the molten aluminum alloy inside the low-pressure casting device is closed to implement the low-pressure casting process.

In order to close the molten aluminum alloy in the diversion trench under the pressure of compressed air, the non-return stopper and the diversion trench are arranged in plunger-type tapered fit, the non-return stopper is fitted with the diversion trench through an oblique tapered surface, and the tapered angle is between 0° and 3°.

According to the low-pressure casting device of the present application, a center plunger is required to close the cavity of the mold before the non-return stopper is opened, with the purpose that the molten aluminum alloy is smoothly injected into the designated liquid level in the pressure kettle rather than flowing into the cavity of the mold in advance.

The center plunger of the present application closes the mold in tapered fit, and the tapered angle is between 0° and 5°.

According to the low-pressure casting device of the present application, a liquid level detection device B is arranged in the pressure kettle to limit the upper limit of the liquid level of the pressure kettle, and a liquid level detection device C is arranged in the pressure kettle to limit the lower limit of the liquid level of the pressure kettle. The upper limit is calculated from the weight of a casting and the amount of molten aluminum alloy to be fed, and the lower limit is flush with the liquid level detection position of a center sprue at the lower part of the mold.

The present application cancels the riser tube, and reduces the liquid rising time by 10 seconds. The pressure kettle replaces original injection of compressed air into the holding furnace, thereby saving 90% of compressed air, reducing the pressure relief time by 20 seconds, and improving the production efficiency of the low-pressure casting process by 15%.

In the present application, the non-return stopper is used to space the low-pressure casting main machine from the holding furnace, and molten aluminum alloy may be added into the holding furnace in real time without interrupting the low-pressure casting process, so that rejects affected by temperature field changes due to interrupt of the continuous casting process may be reduced, and the yield of the casting process is improved by at least 1 percent.

BRIEF DESCRIPTION OF DRAWINGS

FIG. 1 is a schematic diagram of device in an aluminum alloy low-pressure casting process according to the present application.

In figures: 1—casting main machine, 2—mold, 3—diversion trench, 4—liquid level detection device A, 5—pressure kettle, 6—liquid level detection device B, 7—liquid level detection device C, 8—non-return stopper, 9—holding furnace, 10—holding furnace inlet, 11—center plunger.

DETAILED DESCRIPTION OF THE INVENTION

An aluminum alloy low-pressure casting process comprises the steps of opening a non-return stopper 8 after a mold 2 is closed, injecting molten aluminum alloy into a holding furnace 9 through a diversion trench 3, closing the non-return stopper 8 after the molten aluminum alloy in a pressure kettle 5 reaches an upper limit of the liquid level, opening a center plunger 11 at the same time, injecting compressed air into the pressure kettle 5 to implement a filling mold and holding process of low-pressure casting, unloading the pressure in the pressure kettle and evacuating the compressed air after a casting in the cavity of the mold is completely solidified, opening the mold to take the casting out, thus completing the entire low-pressure casting process.

According to a low-pressure casting device, including casting main machine 1, mold 2, diversion trench 3, liquid level detection device A 4, pressure kettle 5, liquid level detection device B 6, liquid level detection device C 7, non-return stopper 8, holding furnace 9, holding furnace inlet 10, center plunger 11, a non-return stopper 8 arranged on a diversion trench 3 spaces a low-pressure casting main machine 1 from a holding furnace 9 to add molten aluminum alloy into the holding furnace 9 continuously. When the non-return stopper 8 is opened, the molten aluminum alloy in the holding furnace 9 flows into the diversion trench 3 for casting. When the non-return stopper is closed, the molten aluminum alloy inside the low-pressure casting device is closed to implement the low-pressure casting process.

In order to close the molten aluminum alloy in the diversion trench under the pressure of compressed air, the non-return stopper 8 and the diversion trench 3 are arranged in plunger-type tapered fit. The non-return stopper 8 is fitted with the diversion trench 3 through an oblique tapered surface, and the tapered angle is between 0.5° and 3°.

According to the low-pressure casting device of the present application, a center plunger 11 is required to close the cavity of the mold before the non-return stopper 8 is opened, to ensure that the molten aluminum alloy is smoothly injected into the designated liquid level in the pressure kettle 5 rather than flowing into the cavity of the mold in advance.

The center plunger 11 of the present application closes the mold in tapered fit, and the tapered angle is between 0.5° and 5°.

According to the low-pressure casting device of the present application, a liquid level detection device B 6 is arranged in the pressure kettle 5 to limit the upper limit of the liquid level of the pressure kettle, and a liquid level detection device C 7 is arranged in the pressure kettle to limit the lower limit of the liquid level of the pressure kettle. The upper limit is calculated from the weight of a casting and the amount of molten aluminum alloy to be fed, and the lower limit is flush with the liquid level detection position of a center sprue at the lower part of the mold.

The foregoing descriptions of specific exemplary embodiments of the present application have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An aluminum alloy low-pressure casting device, wherein that a non-return stopper arranged on a diversion trench spaces a low-pressure casting main machine from a holding furnace, the non-return stopper and the diversion trench are arranged in plunger-type tapered fit, the non-return stopper is fitted with the diversion trench through an oblique tapered surface, and a tapered angle of the non-return stopper is between 0° and 3°;

a center plunger is required to close a cavity of a mold before the non-return stopper is opened;

the center plunger closes the mold in tapered fit, and a tapered angle of the center plunger is between 0° and 5°;

a liquid level detection device B is arranged in a pressure kettle to limit a upper limit of a liquid level of the pressure kettle, and a liquid level detection device C is arranged in the pressure kettle to limit a lower limit of the liquid level of the pressure kettle;

a liquid level detection device A is arranged at the lower part of the mold, and a position of the liquid level detection device A and a position of the liquid level detection device C are flush.

2. The aluminum alloy low-pressure casting device according to claim 1, wherein that the non-return stopper is fitted with the diversion trench through the oblique tapered surface, and the tapered angle of the non-return stopper is between 0.5° and 3°; the center plunger closes the mold in tapered fit, and the tapered angle of the center plunger is between 0.5° and 5°.

* * * * *